US011479386B1

(12) United States Patent
Brittnell

(10) Patent No.: US 11,479,386 B1
(45) Date of Patent: Oct. 25, 2022

(54) STACKING AND ORGANIZATION DEVICE FOR CANS AND OTHER CONTAINERS

(71) Applicant: Morne Brittnell, Orlando, FL (US)

(72) Inventor: Morne Brittnell, Orlando, FL (US)

( * ) Notice: Subject to any disclaimer, the term of this patent is extended or adjusted under 35 U.S.C. 154(b) by 0 days.

(21) Appl. No.: 17/223,327

(22) Filed: Apr. 6, 2021

Related U.S. Application Data

(60) Provisional application No. 63/006,412, filed on Apr. 7, 2020.

(51) Int. Cl.
*B65D 21/02* (2006.01)
*A47F 7/28* (2006.01)

(52) U.S. Cl.
CPC ..... *B65D 21/0224* (2013.01); *A47F 7/281* (2013.01)

(58) Field of Classification Search
CPC .... B65D 71/50; B65D 71/70; B65D 21/0224; A47F 7/281
USPC ..... 206/509
See application file for complete search history.

(56) References Cited

U.S. PATENT DOCUMENTS

D188,152 S 6/1960 Trost
2,957,601 A * 10/1960 Novick ..... B65D 21/0224 206/503
3,173,574 A * 3/1965 Goldsmith ..... B65D 51/20 206/508
D224,928 S 10/1972 Wiley
3,751,098 A 8/1973 Owen
D236,326 S 8/1975 Trebilcock
4,116,332 A * 9/1978 Hartley ..... B44D 3/12 206/209
4,564,106 A 1/1986 Shilcock
D296,268 S 6/1988 Bozarth
4,823,959 A * 4/1989 Bixler ..... A47G 23/0208 206/159
D310,027 S * 8/1990 Bixler ..... D9/752
5,156,273 A * 10/1992 Mortensen ..... B29C 65/08 156/321
D353,242 S 12/1994 McCoy et al.
D358,841 S 5/1995 Ascone
D368,736 S 4/1996 Massena
5,503,858 A 4/1996 Reskow
D373,865 S * 9/1996 Wells ..... D32/54
D377,753 S 2/1997 Meadows
5,636,753 A * 6/1997 Wilkinson ..... A47F 7/281 211/59.4
D395,238 S 6/1998 Freitas
D405,687 S 2/1999 Borg
D412,663 S 8/1999 Erickson
5,964,343 A * 10/1999 Steiner ..... B65D 71/70 206/203
6,021,913 A 2/2000 Mcgrath
D441,516 S 5/2001 Wheaton
(Continued)

*Primary Examiner* — Patrick D Hawn
(74) *Attorney, Agent, or Firm* — Gerben Perrott PLLC; Benjamin M. Hanrahan

(57) ABSTRACT

A can stacking and organization device is present herein. The device includes at least one body segment which is formed of an outer wall, an intermediate wall and an inner wall. A first trough is defined between the outer wall and the intermediate wall, and a second trough is defined between the intermediate wall and the inner wall. The intermediate wall includes at least one indentation formed upon a top surface thereof, such that material collected within the first trough can overflow through the indentation and into the second trough.

12 Claims, 17 Drawing Sheets

(56) References Cited

U.S. PATENT DOCUMENTS

D502,406 S 3/2005 Eddings
D511,894 S 11/2005 Janney, Jr. et al.
D560,047 S * 1/2008 Kershaw ..... D32/54
7,404,486 B2 7/2008 Smithers et al.
D590,715 S * 4/2009 Gilfert ..... D9/456
D594,164 S 6/2009 Lee et al.
D600,748 S 9/2009 Tabuchi et al.
7,588,275 B2 * 9/2009 Borg ..... B65D 21/0224 206/151
7,614,495 B1 * 11/2009 Smithers ..... B65D 81/361 206/150
D631,343 S 1/2011 Blunck
7,861,853 B2 * 1/2011 Borg ..... B65D 71/50 206/151
D632,960 S * 2/2011 Gilfert ..... D9/456
D678,409 S * 3/2013 Papenfuβ ..... D19/106
D704,572 S * 5/2014 Borg ..... D9/752
9,327,890 B1 * 5/2016 Connelly ..... B65D 71/70
9,517,859 B2 * 12/2016 Borg ..... B65D 21/0224
D781,158 S * 3/2017 Bosworth ..... D9/752
D831,503 S * 10/2018 Borg ..... D9/753
D844,398 S 4/2019 Dubois
10,293,999 B2 * 5/2019 Warren ..... B65D 71/70
10,364,080 B2 * 7/2019 Tetreault ..... B65D 71/50
D859,909 S * 9/2019 Murad ..... D7/357
D884,304 S * 5/2020 Wheaton ..... D34/38
D885,915 S * 6/2020 Coughanour ..... D9/456
D901,298 S * 11/2020 Brittnell ..... D9/456
D911,664 S * 2/2021 Wheaton ..... D34/38
10,906,792 B2 * 2/2021 Karras ..... B44D 3/00
11,111,063 B2 * 9/2021 Borg ..... B29C 45/0081
11,111,064 B2 * 9/2021 Clark ..... B65D 71/70
2002/0148845 A1 * 10/2002 Zettle ..... B65D 43/021 220/781
2005/0138887 A1 * 6/2005 Kanachowski ..... B65D 71/70 52/741.1
2008/0224489 A1 * 9/2008 Borg ..... B65D 71/50 294/87.28
2008/0302691 A1 * 12/2008 Olson ..... B65D 5/48026 206/427
2010/0025360 A1 * 2/2010 Borg ..... B65D 71/50 215/386
2011/0290815 A1 * 12/2011 Weld ..... B65D 21/0224 220/715
2012/0073997 A1 * 3/2012 Borg ..... B65D 21/0219 206/150
2015/0210428 A1 * 7/2015 Borg ..... B65D 21/0219 24/288
2018/0086524 A1 * 3/2018 Tetreault ..... B65D 71/50
2018/0346194 A1 * 12/2018 Coughanour ..... B65D 21/0224

* cited by examiner

STACKING AND ORGANIZATION DEVICE FOR CANS AND OTHER CONTAINERS

CLAIM OF PRIORITY/CROSS-REFERENCE TO RELATED APPLICATION

The present application is based on and a claim of priority is made under 35 U.S.C. § 119(e) to provisional patent application Ser. No. 63/006,412, filed on Apr. 7, 2020, the contents of which are incorporated herein in their entirety by reference.

FIELD OF THE INVENTION

The present invention is directed to a stacking and organization device, and in particular, a stacking and organization device for stacking and organizing cans, including, but not limited to cans of paint and other products and materials.

BACKGROUND OF THE INVENTION

Cans, buckets and other containers, including but in no way limited to paint cans, soup cans, oil cans/containers, etc. often need to be organized, stacked, and labeled. This can be true for manufacturers or retailers (e.g., stores and other locations where a large amount of cans may be stored for sale or distribution), as well as consumers (e.g., home owners) or professionals (e.g., painters or other service providers). Furthermore, particularly in the case of paint cans, but also for cans or other containers that hold other products or materials, the paint or other material may drip or spill down the side of the can or container. Without any retention mechanism or feature, the paint or other material will often drip down to the floor or other surface, potentially damaging or destroying that surface.

Accordingly, there is a need in the art for a storage and organization device that can be used to store, retain and organize one or a plurality of cans, including but not limited to paint cans. It would also be beneficial if the device included a feature or function that would catch or retain any paint or other material that may drip down the side of the can or other container. In this manner, it would be advantageous for a retention channel or retention trough to be formed in the device, itself, that would catch and retain dripping paint or other product, thereby preventing the product from reaching and potentially damaging the floor or other supporting surface upon which the can or other container is disposed.

SUMMARY OF THE INVENTION

Accordingly, the present invention is directed to a storage and organization device which can be used to store, organize, and stack various cans, buckets or other containers. While certain embodiments are described herein with regard to cans, buckets or containers or paint, it should be noted and apparent that virtually any can, bucket or container can be used with the various embodiments of the present invention, including, but in no way limited to soup cans, oil cans or containers, etc.

In particular, the device of the present invention includes at least one body segment upon which a can or other container can be stacked or stored. In some embodiments, the device may include a plurality of body segments which are attached or joined to one another at common edges. In such a cases, each of the individual body segments may be used to hold or store a separate can or container. In addition, a second or another stacking and organization device may be placed upon the top surface of the can or container, which can then allow another one or more cans or containers to be stacked thereupon. In this manner, alternating between a can stacking device and one or more cans, a number of layers of cans or containers can be stacked upon one another.

Furthermore, each of the body segments of at least one embodiment is formed by concentric walls defined as an outer wall, an intermediate wall and an inner wall. In many implementations, the outer wall has a height greater than the intermediate wall, and the intermediate wall has a height greater than the inner wall such that the walls descend in height from the outside inward, however, other embodiments may have different implementations and heights.

In addition, between the outer wall and the intermediate wall of at least one embodiment is a first trough. The first trough is used to collect and retain any spilled paint or other material that may drip down the outside wall or surface of the can or container. If the first trough is overfilled, e.g., if the amount of paint or other material is too much for the volume of the first trough to retain, the paint or other product may overflow to a second trough that is disposed between the intermediate wall and the inner wall. In some embodiments one or more indentations or channels may be formed on the top surface of the intermediate wall to facilitate the overflow of paint or other material into the second trough.

Additional features of at least one embodiment may include a mobile or other application which can be used to store, track and maintain various specific details of the cans or container, but more practically, the contents of the cans or containers. For example, the application can be used to store various information pertaining to the location of which the paint is or will be applied, as well as the make (e.g.. brand), color, finish, tint, etc. of the paint. This allows subsequent recollection of the particular paint to be easy, particular in the event the user would like to purchase touch-up paint, repaint the wall the same color, or match the color for another wall or location. Further features of the application may include generating and communicating coupons, discounts or other incentives to the user, providing the user with local retailers of the paint or other product, matching the user with local professionals (e.g., painters or other service providers), etc.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
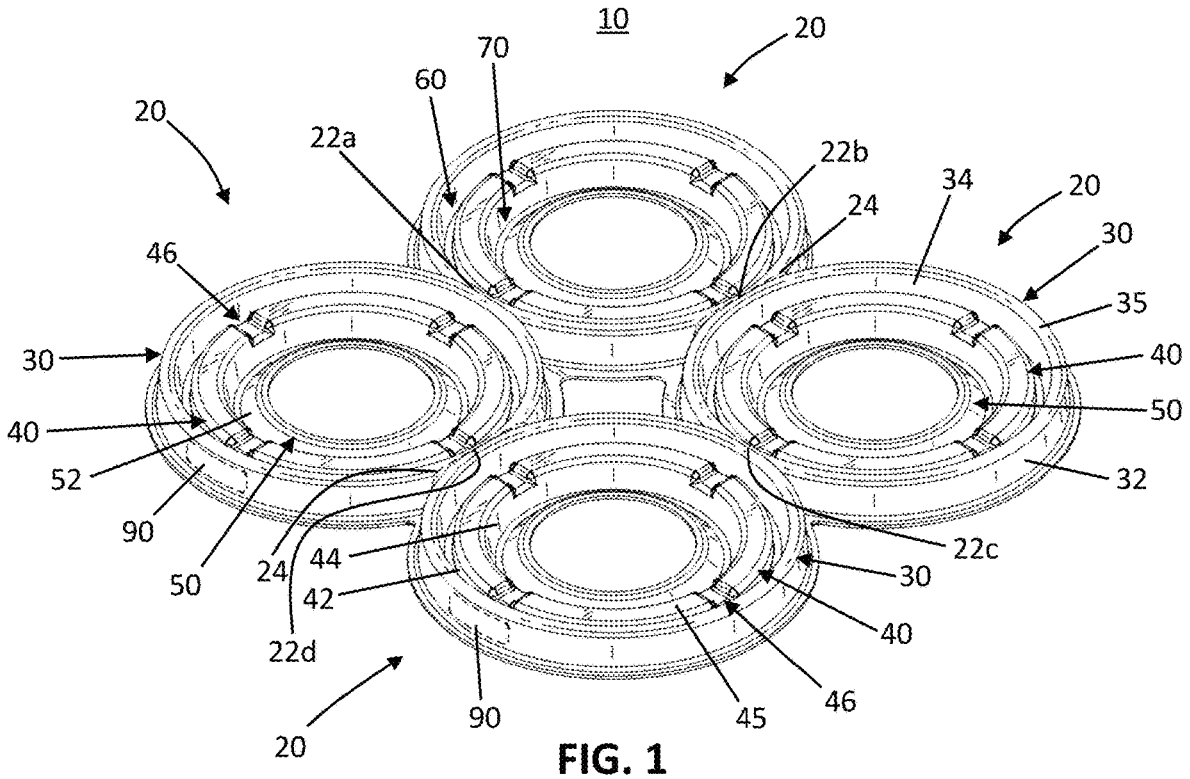
FIG. 1 is a top perspective view of at least one embodiment of the storage and organization device as disclosed herein.

As shown in the accompanying drawings, and with particular reference to FIGS. 1 through 6, the present invention is directed to a stacking and organization device, generally referenced as 10, for one or more cans or containers. In particular, the can or container stacking and organization device 10 of at least one embodiment of the present invention is structured, shaped and designed for use in connection with paint cans, paint buckets or paint containers of virtually any size, including but in no way limited to one quart paint cans or containers, one gallon paint cans or containers, five gallon paint cans, buckets or containers, etc. It should be noted however, that the can or container stacking and organization device 10 as described in accordance with the various embodiments herein can be used with or for virtually any types or sizes of cans, buckets or other containers, such as, but in no way limited to, soup cans or containers, oil cans or containers, or other cans, containers, or buckets used to hold or store other various items or products.

In any event, with reference to FIGS. 1 through 6, the stacking and organization device 10 of at least one embodiment includes one or more body segments, referenced as 20. In the embodiment shown in FIGS. 1 through 6, the stacking and organization device 10 includes four body segments 20 joined to one another at common joints or edges 22*a*, 22*b*, 22*c*, 22*d*. However, it should be noted that the can or container stacking and organization device 10 of the various embodiments described herein can include a single body segment 20, two body segments 20, three body segments, four body segments 20, or virtually any number of body segments 20 and still fall within the full spirit and scope of the present invention. Furthermore, in some cases, optional reinforcement sections 24 may, but need not necessarily, be included at or near the joints or common edges 22*a-c* in order to provide additional support and structural integrity.

Figure 12:
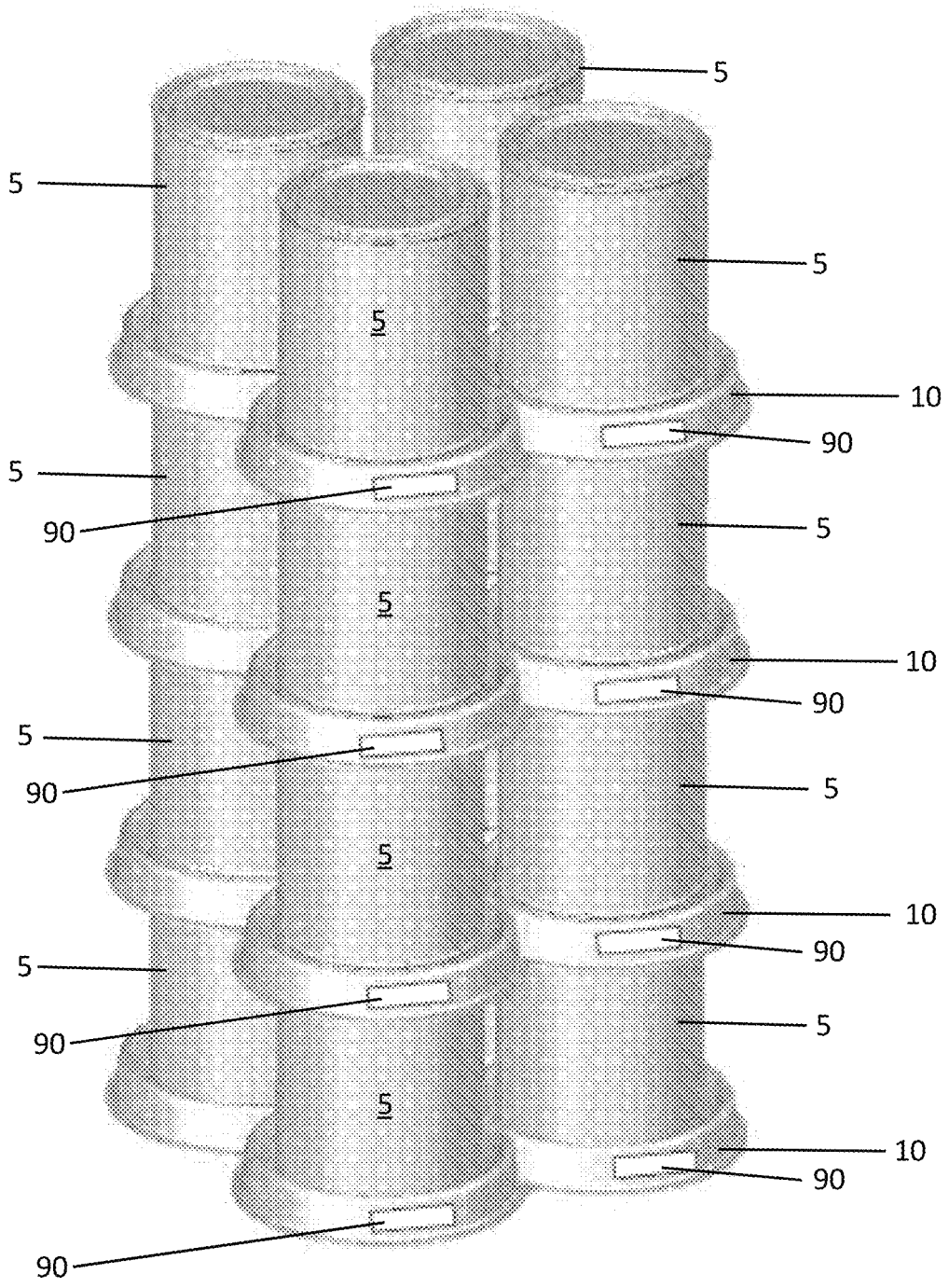
FIG. 12 is a partial perspective view of a plurality of storage and organization devices used to alternately and stack a plurality of containers.

With reference briefly to FIG. 12, the can or other container stacking and organization device 10 is shown in operation wherein a plurality of cans 5 or other containers are supported within or between separate devices 10. In particular, the device 10 of at least one embodiment is configured to support a bottom surface of a can or container 5, and to be supported upon a top surface of the can or container 5, as generally shown in FIG. 12. In this manner, the paint cans or other cans, containers, etc. can be organized by being stacked upon a device 10 of the present invention. Additional cans or containers 5 can then be vertically stacked thereupon by alternating between a stacked device 10 and a can or container 5, as shown.

With reference again to FIG. 1, the body segment(s) 20 of at least one embodiment includes or otherwise defines an outer wall 30, an intermediate wall 40 and an inner wall 50. As shown in the exemplary embodiment, the body segments 20, and in particular, the walls 30, 40, 50 thereof include a circular shape and configuration, however, other embodiments which may be operate with other shaped cans or containers may have a different shape or configurations, such as, but not limited to square, hexagon, octagon, etc. In addition, as shown in the exemplary embodiment of FIGS. 1 through 6, the outer wall 30, intermediate wall 40 and inner wall 50 are concentric or otherwise form concentric circular configurations. More specifically, each of the walls 30, 40, 50 of at least one embodiment include a top surface 35, 45, 55, respectively, which can form concentric circles or rings, or which can each share a central axis.

Furthermore, in at least one embodiment, the outer wall 30 may include a continuous circular or other configuration defining an outer surface 32, an inner surface 34 and a top surface 35. In other words, the outer wall 30 of at least one embodiment, and in particular, the top surface 35 thereof, may be a continuous, and in some cases, generally flat, surface defining an outer ring.

Additionally, intermediate wall 40 may be defined as including an outer surface 42, an inner surface 44 and a top surface 45. Formed between the intermediate wall 40 and the outer wall 30, and in particular, between inner surface 34 of outer wall 30 and outer surface 42 of intermediate wall 40, is a first trough 60. In particular, the first trough 60 is defined as a trench or lower channel between outer wall 30 and intermediate wall 40.

Figure 8A:
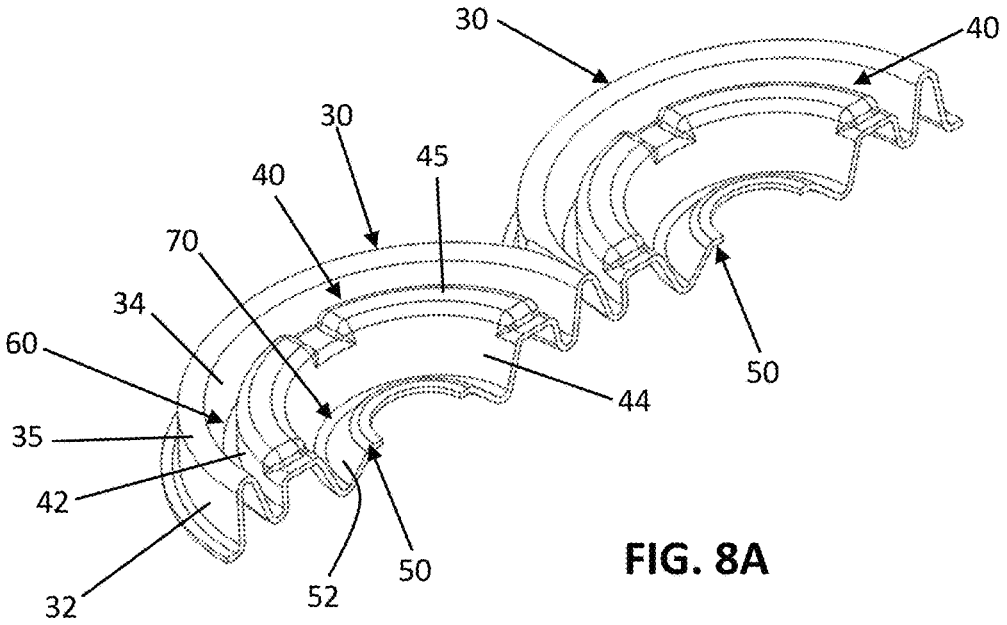
FIG. 8A is a perspective cut-away view of the embodiment illustrated in FIG. 7.
Figure 8B:
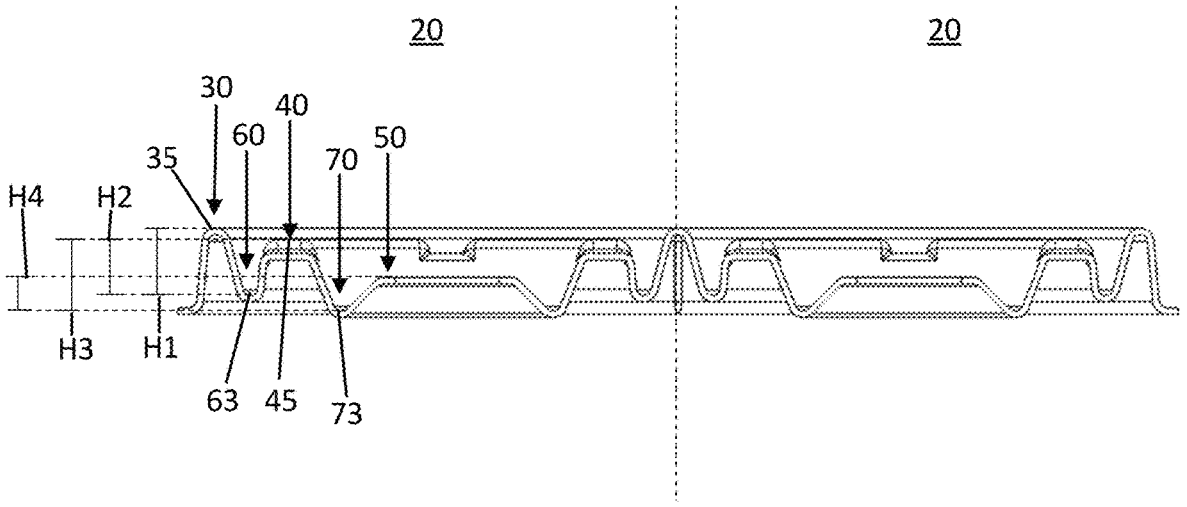
FIG. 8B is an elevation cut-away view of the embodiment illustrated in FIG. 7.
Figure 9A:
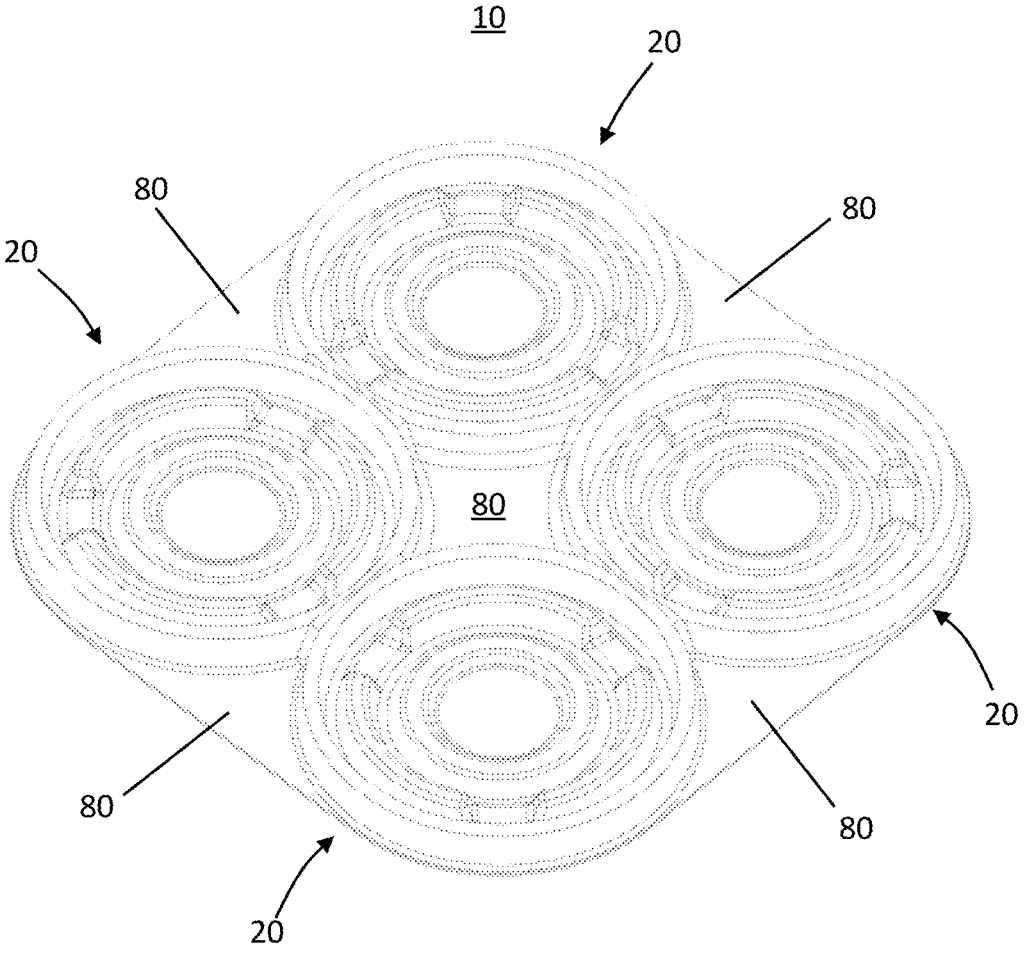
FIG. 9A is a top perspective of another embodiment of the storage and organization device as disclosed herein.
Figure 9B:
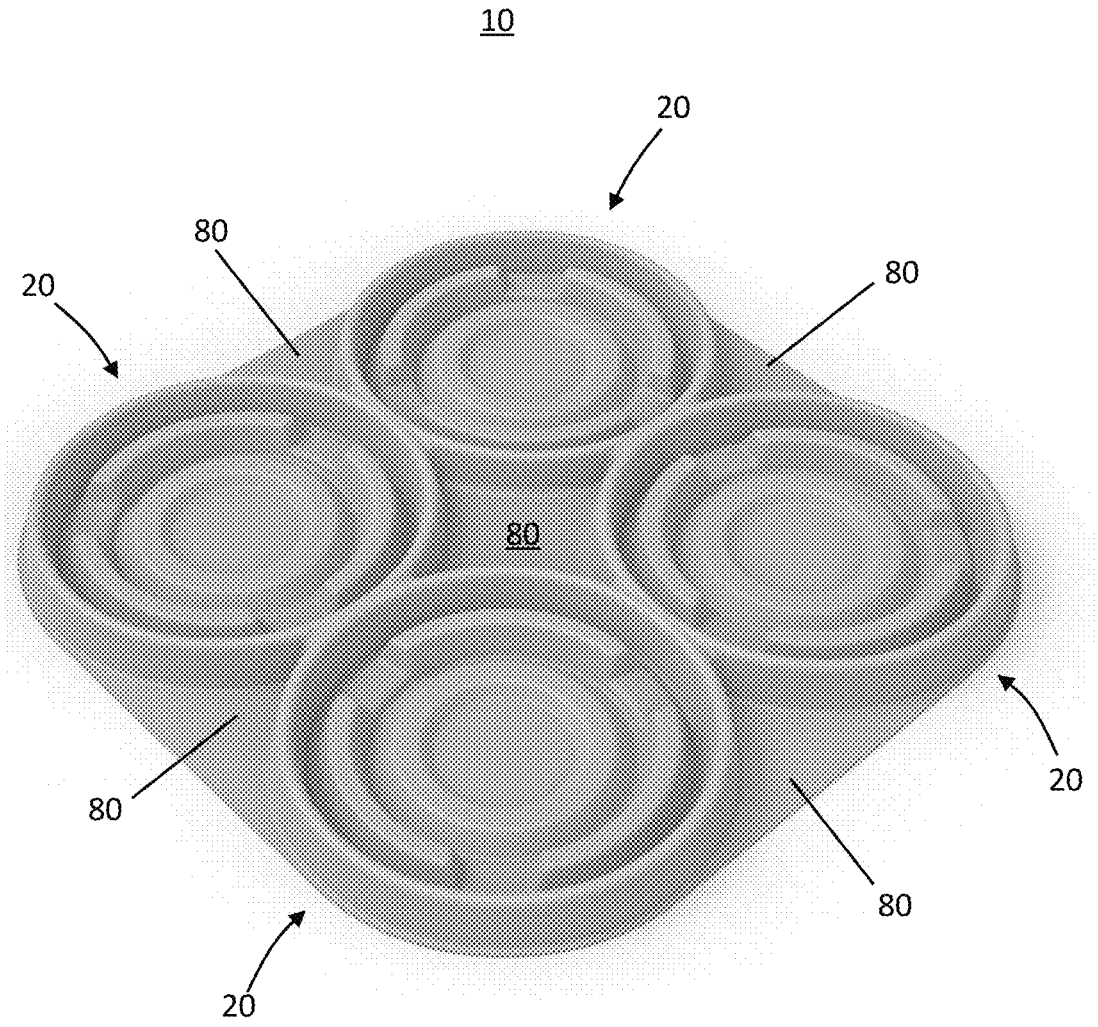
FIG. 9B is another top perspective view of the embodiment illustrated in FIG. 9A.
Figure 10A:
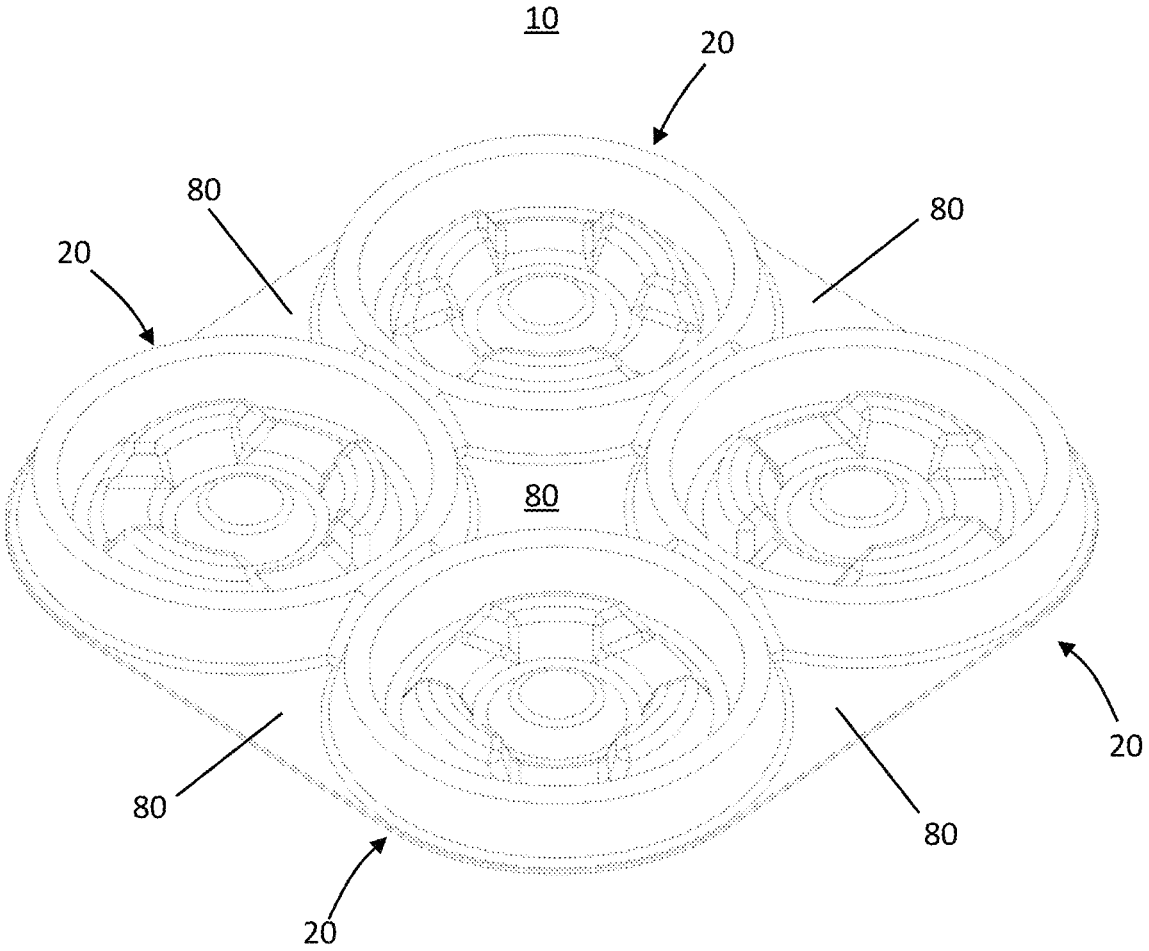
FIG. 10A a top perspective of another embodiment of the storage and organization device as disclosed herein.
Figure 10B:
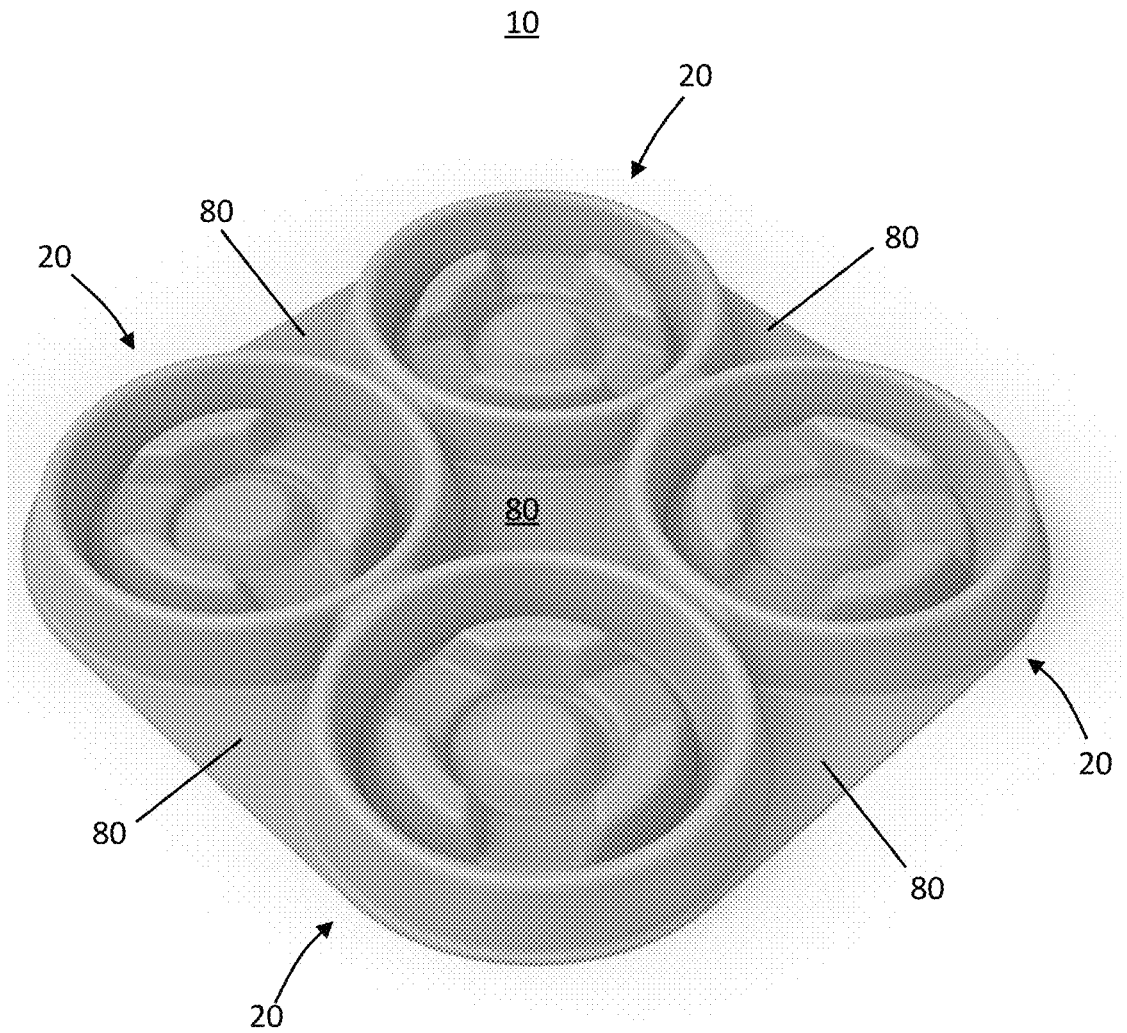
FIG. 10B is another top perspective view of the embodiment illustrated in FIG. 10A.

With reference to the cut-away views of FIGS. 8A and 8B, first trough 60 is shown as a dip or recess between walls 30, 40. Furthermore, in at least one embodiment, the outer wall 30 includes an inner height H1 that is greater than an outer height H2 of intermediate wall 40. More in particular, inner height H1 of outer wall 30 is defined as the height extending or measured between bottom surface 63 of the first trough 60 to the top surface 35 of outer wall 30. Similarly, the outer height H2 of the intermediate wall 40 is defined as the height extending or measured between the bottom surface 63 of first trough 60 to the top surface 45 of intermediate wall 40. As shown in the exemplary embodiment of FIG. 8B, H1 is greater than H2 in that the top surface 35 of outer wall 30 extends higher than top surface 45 of intermediate wall 40.

Moreover, the body segments 20 of at least one embodiment further define a second trough 70 between the intermediate wall 40 and the inner wall 50. For example, second trough 70 is formed between inner surface 44 of the intermediate wall 40 and the outer surface 52 of inner wall 50. For instance, with reference again to the cut-away views of FIGS. 8A and 8B, second trough 70 is shown as a dip or recess between walls 40, 50. Furthermore, in at least one embodiment, the intermediate wall 40 includes an inner height H3 that is greater than a height H4 of inner wall 50. More in particular, inner height H3 of intermediate wall 40 is defined as the height extending or measured between bottom surface 73 of the second trough 70 to the top surface 45 of intermediate wall 40. Similarly, the height H4 of the inner wall 50 is defined as the height extending or measured between the bottom surface 73 of second trough 70 to the top surface 55 of inner wall 50. As shown in the exemplary embodiment of FIG. 8B, H3 is greater than H4 in that the top surface 45 of intermediate wall 40 extends higher than top surface 55 of inner wall 50.

Furthermore, in at least one embodiment, the intermediate wall 40 includes one or more indentations or channels 46 disposed along or otherwise formed upon the top surface 45 thereof. More in particular, the indentation(s) or channel(s) 46 extend between the outer surface 42 and the inner surface 44 of the intermediate wall 40 and resemble a dip or cut out portion along the top surface 45 thereof. In some embodiments, a plurality of indentations 46 are disposed or spaced along the top surface 45 of the intermediate wall 40. For example, with reference to FIGS. 1, 5 and 7, four indentations or channels 46 are shown as being spaced along the top surface 45 of the intermediate wall 40. In some cases, the plurality of indentations or channels 46 are equidistantly spaced or otherwise formed along the intermediate wall 40 in that the distances between adjacently disposed indentations are all equal. It should be noted that in other embodiments, the indentations 46 may not be equidistantly formed or spaced. It should also be noted that other embodiments may include more than four indentations 46 or less than four indentations 46, such as, but not limited to, in the embodiments shown in FIGS. 9A through 10B wherein three indentations are illustrated.

More in particular, in use and when a can or other container, such as but not limited to a paint can is supported upon the can stacking device 10 or upon a body segment 20 of a can stacking device 10 of the present invention, the first and second troughs 60, 70, as well as the indentations or recesses 47 in the intermediate wall 40 function to receive and retain spilled paint or other materials from the can 5 or container. Specifically, in some instances, the outer circumference of the can or container 5 may overlay the intermediate wall 40 (e.g., extend outward beyond the intermediate wall 40), but remain on the inside of the outer wall 30. In other words, in use, the outer side walls of the can 5 may be disposed between the intermediate wall 40 and the outer wall 30. In this manner, if (and in many cases, when) paint or other materials drip down the outside walls of the can 5, the paint or other material will fall into and be retained within the first trough 60, which is disposed between the outer wall 30 and the intermediate wall 40.

If the amount of paint or other material, product, liquid, etc. fills or substantially fills the first trough 60, the indentation(s) 47 formed on the top surface 45 of the intermediate wall 40 will direct a flow of the paint or other material into the second trough 70. More specifically, as the first trough 60 fills to a level at the bottom end of the indentation(s) 47, the paint or other material will overflow from the first trough 60, through the one or more indentations 47 or channels, and into the second trough 70. This provides two layers or two retention troughs 60, 70 where paint or other material can be caught and retained in the event the material overflows or drips from the can 5 or other container.

In the case of paint cans, buckets or containers, it is common for the paint to drip down the side of the can or bucket, particularly after the paint has been poured from the can or bucket into another container, such as a smaller can or a drip pan or roller pan. If the paint can 5 or other container is placed upon the can stacking device 10 of the present invention, or otherwise upon one of the body segments 20 thereof, any paint or other material that may drip from the can 5 will be caught and retained within the first and/or second troughs 60, 70 as mentioned above. This can prevent the paint or other material from dripping onto the floor or other surface.

Figure 7:
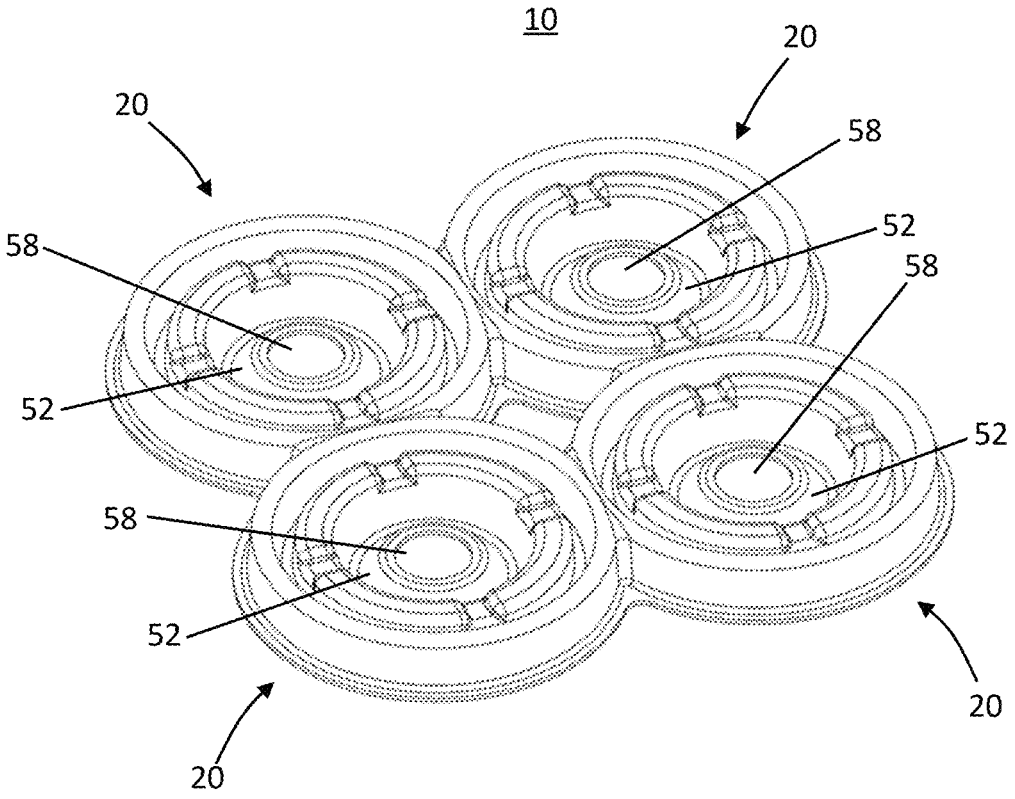
FIG. 7 is a top perspective view of another embodiment of the storage and organization device as disclosed herein.

Of note, FIG. 7 represents a slightly different variation of the can stacking and organization device 10 of the present invention, as compared to the embodiment of FIGS. 1 through 6, in that the inner wall 50 forms a slightly smaller inner aperture 58. More specifically, in some embodiments, the inner wall 50 includes an inwardly sloping surface 52 extending from the bottom surface 73 of the second trough 70 toward the top surface 55 of the inner wall 50. In some embodiments, a hole or aperture 58 is formed in the center of the inner wall 50 that extends through the device 10. In other embodiments, however, as shown, for example, in FIGS. 9B and 10B, a hole or aperture may not be formed in the center of the body segment 20. Rather, in some embodiments, the center of the body segment(s) 20 may be closed or otherwise formed of a section of material.

Still referring to the embodiments of FIGS. 9A, 9B, 10A and 10B, it should be noted that one difference between the embodiments of FIGS. 9A, 9B and 10A, 10B is the size of the device 10 and in particular the size of the body segments 20 thereof. In particular, the embodiment illustrated in FIGS. 9A, 9B may be formed for a can or other container with a larger outer circumference or with a larger diameter than that for the embodiment illustrated in FIGS. 10A, 10B. As just an example, the embodiment illustrated in FIGS. 9A and 9B may be formed or designed for use with one gallon paint (or other) cans, whereas the embodiment illustrated in FIGS. 10A, 10B may be formed or designed for use with one quart paint (or other) cans. Of course, the particular size and shape of the device 10 and in particular the body segments 20 thereof should not be considered limited to use with one gallon or one quart paint cans in that, as indicated herein, cans of virtually any shape and size can be used in connection with different embodiments of the present invention. As such, the shape and size of the device 10 and the body segments 20 thereof can vary from one embodiment or implementation to another and still fall within the full spirit and scope of the present invention.

An additional structural feature of the embodiments illustrated in FIGS. 9A, 9B, 10A and 10B includes a base 80 formed between the body segments 20. More specifically, the base 80 may be included in the formation or construction of certain embodiments of the present invention in that it can provide additional support or increased structural integrity of the device 10 as a whole. In other words, the base 80 may include a piece of material, such as plastic or other material, that fills in the gaps between the body segments 20 and provides additional support and structural integrity. In at least one embodiment, the base 80 does not span across the open bottom of the device 10, and thus, even in the event a base 80 is formed, the device 10 may still include complimentary recesses on the bottom to receive the walls 30, 40, 50 of another device 10, thereby allowing the devices 10 to easily stack upon another, as described below.

Figure 2:
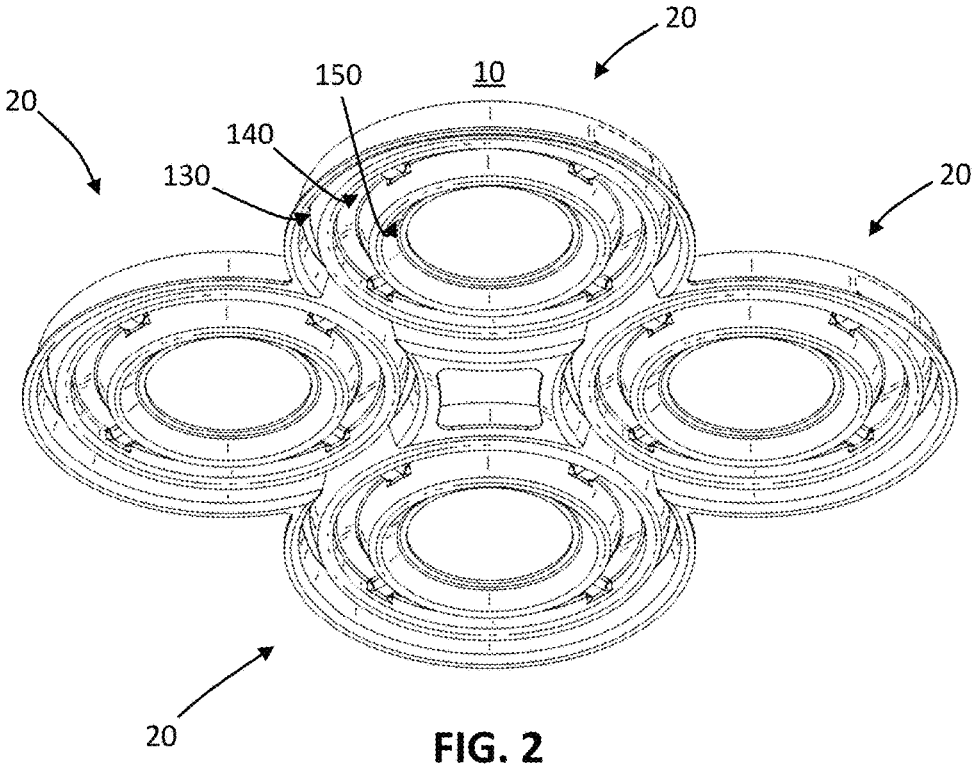
FIG. 2 is a bottom perspective view of the embodiment illustrated in FIG. 1.
Figure 11:
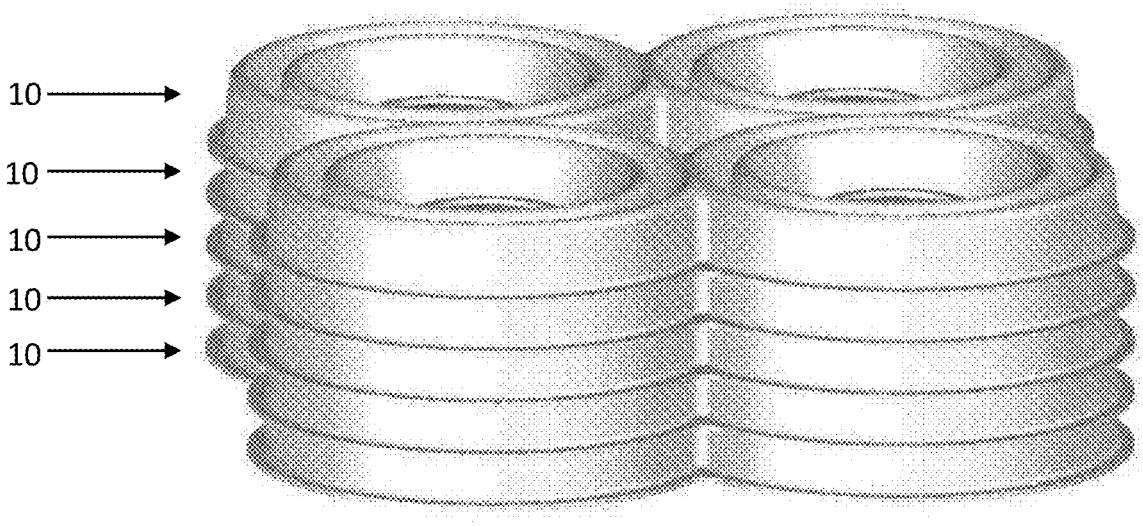
FIG. 11 is a partial perspective view of a plurality of storage and organization devices stacked as disclosed in accordance with at least one embodiment of the present invention.

More in particular, with reference to the bottom perspective view of FIG. 2, the bottom portion of the body segments 20 include a plurality of complimentary or cooperative recesses 130, 140, 150 within which the walls 30, 40, 50 of another device 10 can fit into. This cooperative construction allows the device 10 to be easily stacked upon another device 10, for example, to facilitate storage and/or transportation of a plurality of devices 10. More specifically, the recess 130 is formed or otherwise configured to receive the outer wall 30 of another device; the recess 140 is formed or otherwise configured to receive the intermediate wall 40 of another device; and the recess 150 is formed or otherwise configures to receive the inner wall 50 of another device. FIG. 11 illustrates a plurality of can stacking and organization devices 10 stacked upon on another, again, for purposes of facilitating storage or transportation of the same.

Figure 3:
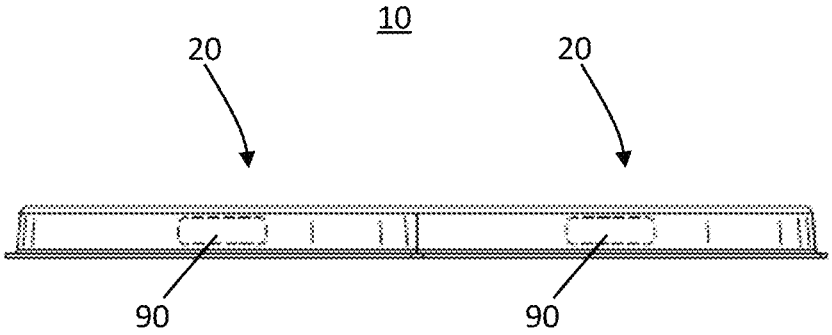
FIG. 3 is a front elevation view of the embodiment illustrated in FIGS. 1-2.
Figure 4:
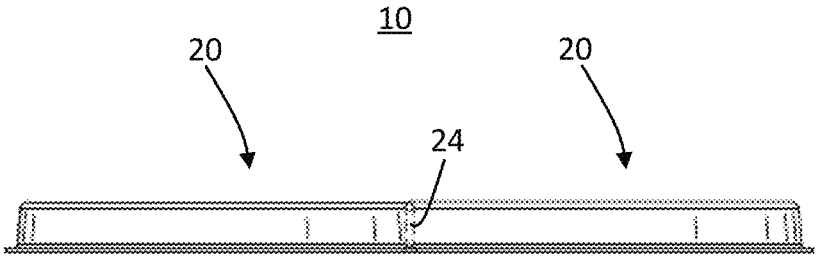
FIG. 4 is a side elevation view of the embodiment illustrated in FIGS. 1-3.
Figure 5:
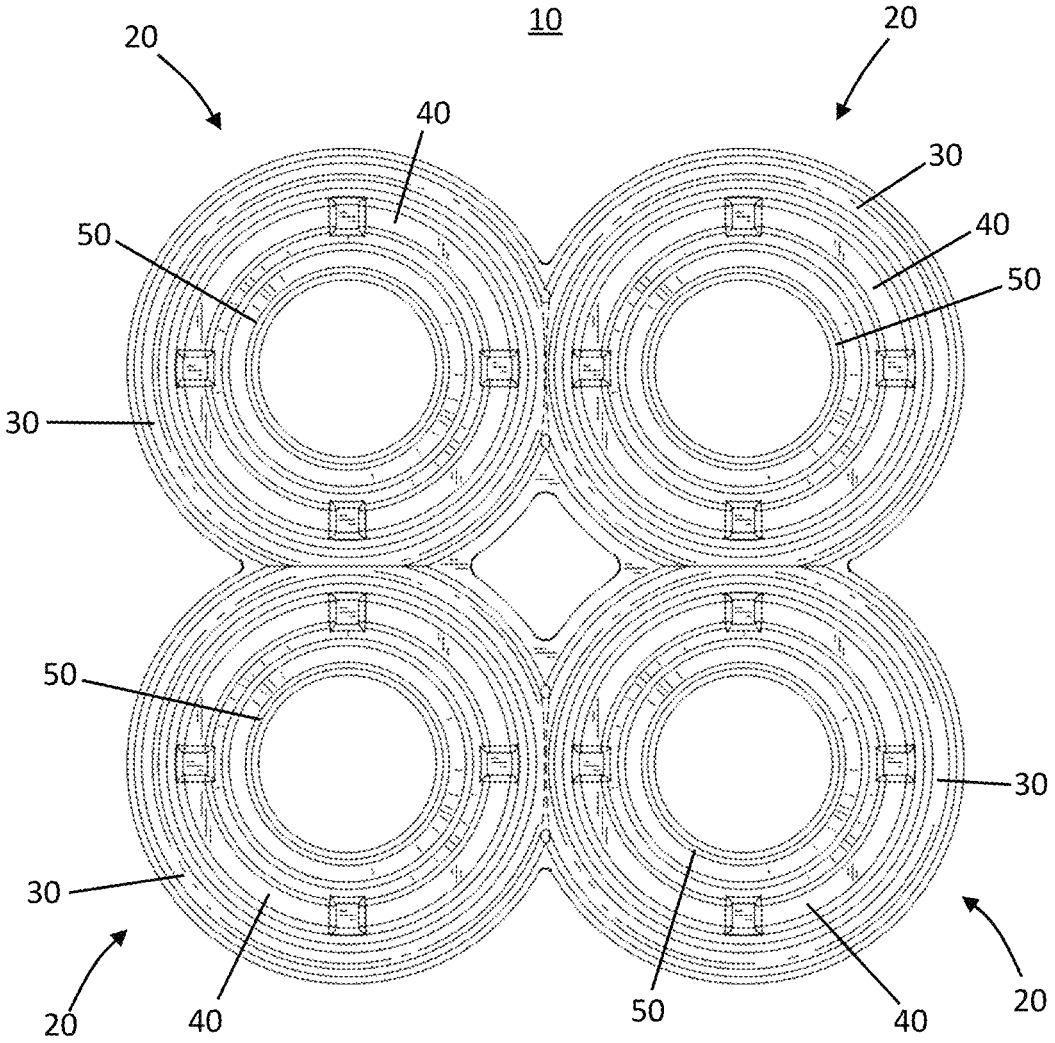
FIG. 5 is a top view of the embodiment illustrated in FIGS. 1-4.
Figure 6:
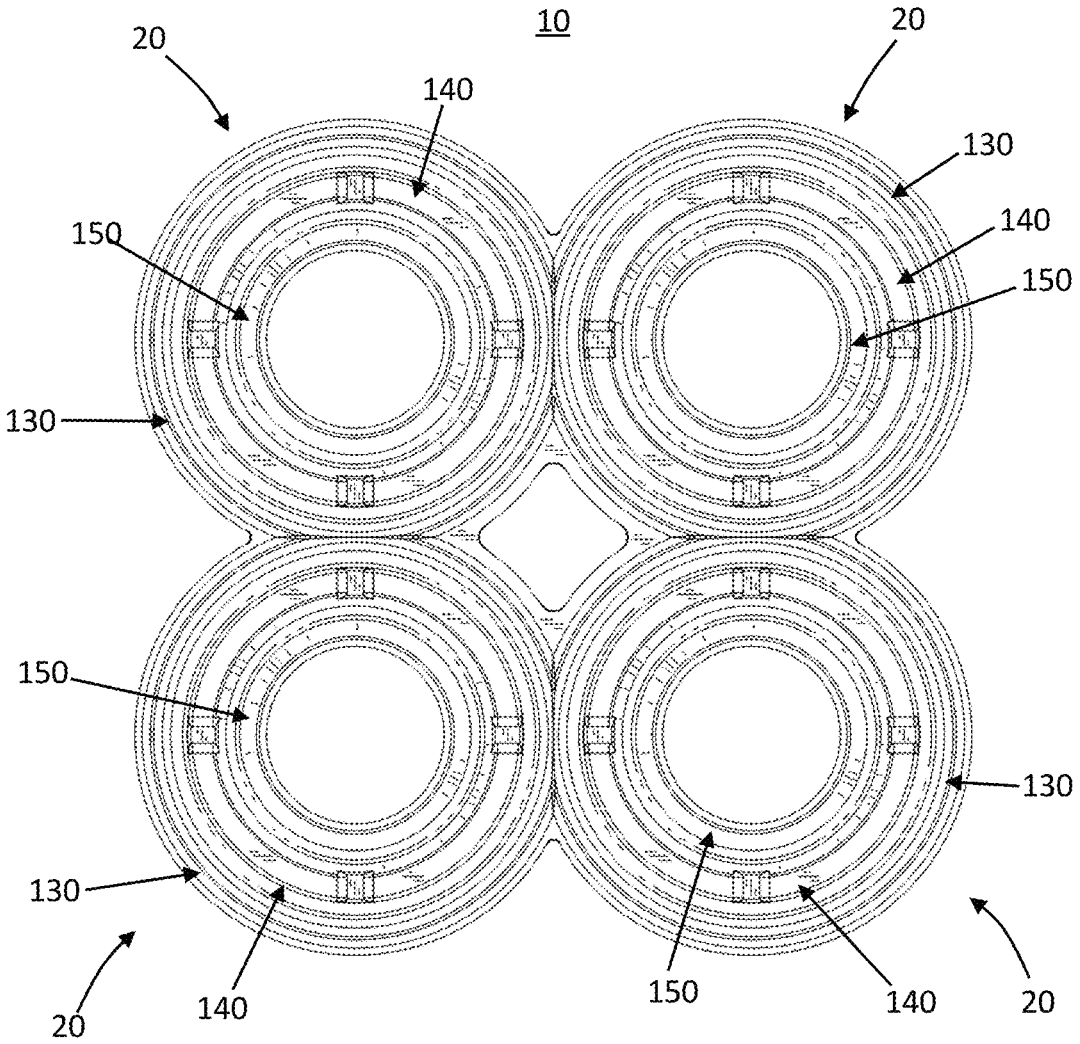
FIG. 6 is a bottom view of the embodiment illustrated in FIGS. 1-5.

Additional features of certain embodiments of the present invention also include one or more sections 90 disposed on the stacking and organization device 10 whereupon a label or other indicia may be placed. For example, as shown in FIGS. 1 and 3, the section(s) 90 may be disposed on the outer surface 32 of outer wall 30. In some cases, a sticker or other adhesively applied label (not shown) can be placed within the label section 90 where certain information about the can or container 5 (e.g., the contents contained within the can or container) can be labeled or identified. In the case of paint, for example, the label may indicate the manufacture of the paint, the color of the paint, the finish of the paint, the location within the home or building where the paint was applied (e.g., living room walls), etc. In some embodiments, it should be noted that instead of, or in addition to, an adhesively applied label, indicia may be written directly upon the device 10 within the label section 90, for example, with a pen, marker dry erase marker, etc.

Figure 13A:
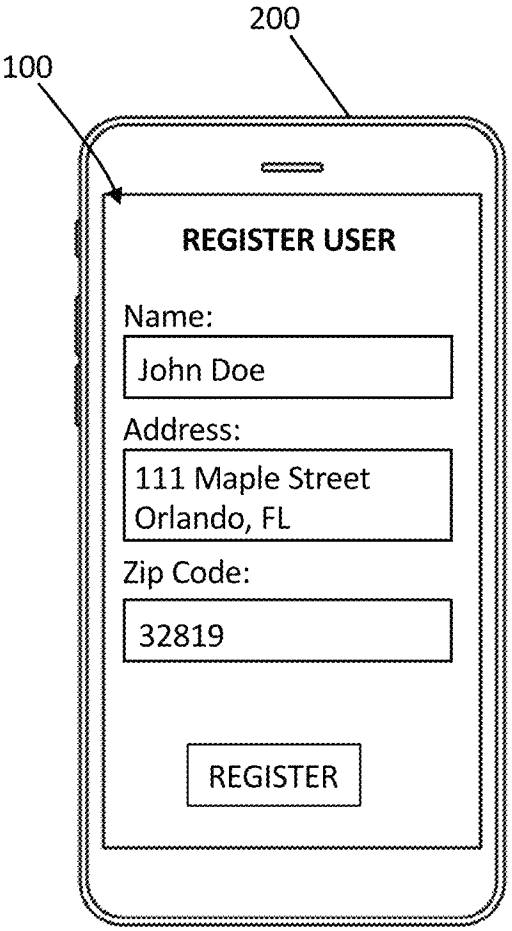
FIGS. 13A through 13O are exemplary screenshot schematics of the application as disclosed in accordance with at least one embodiment of the present invention.
Figure 13B:
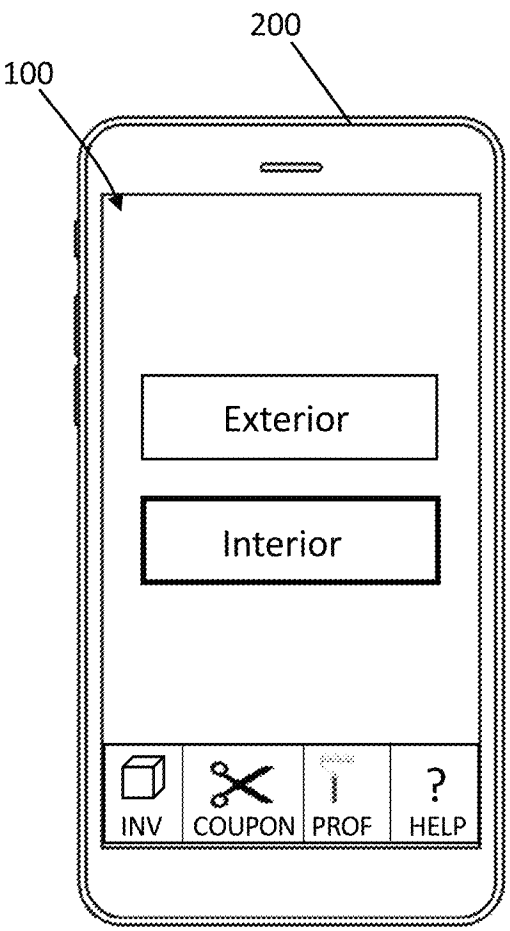
Figure 13C:
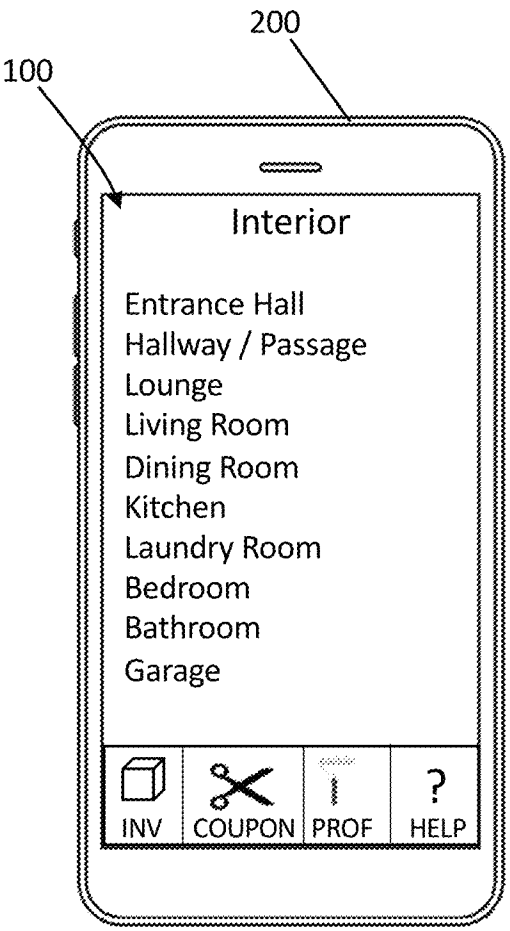
Figure 13D:
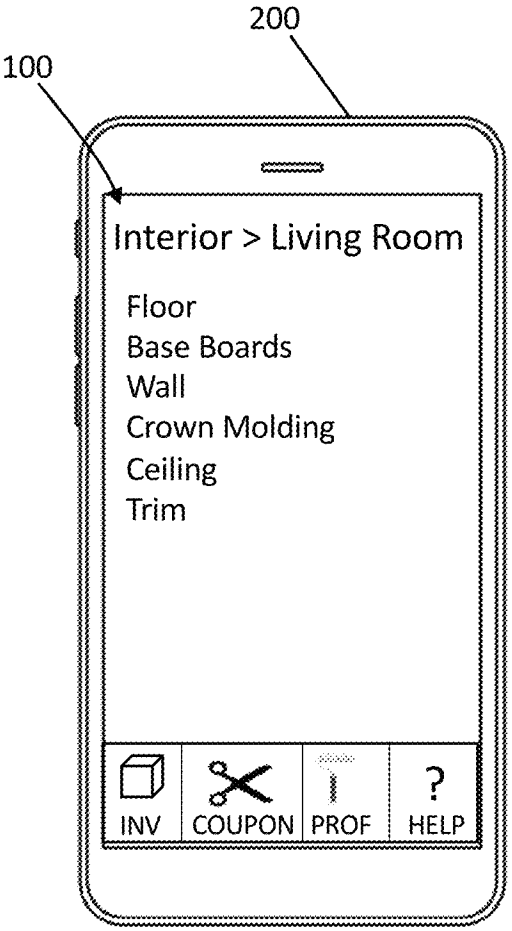
Figure 13E:
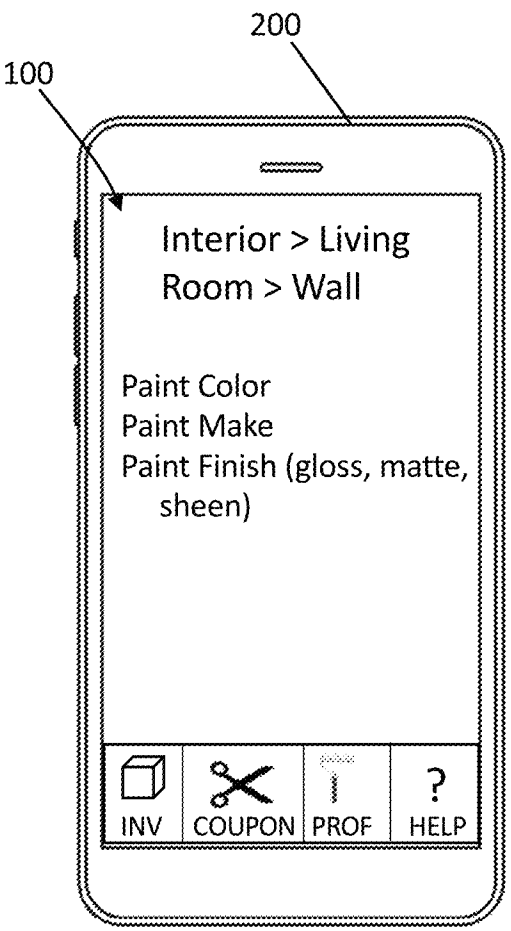
Figure 13F:
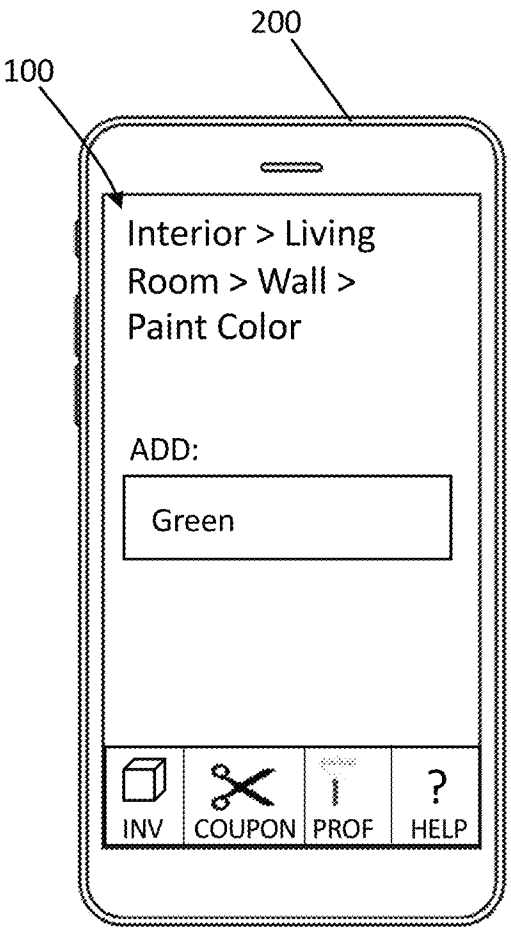
Figure 13G:
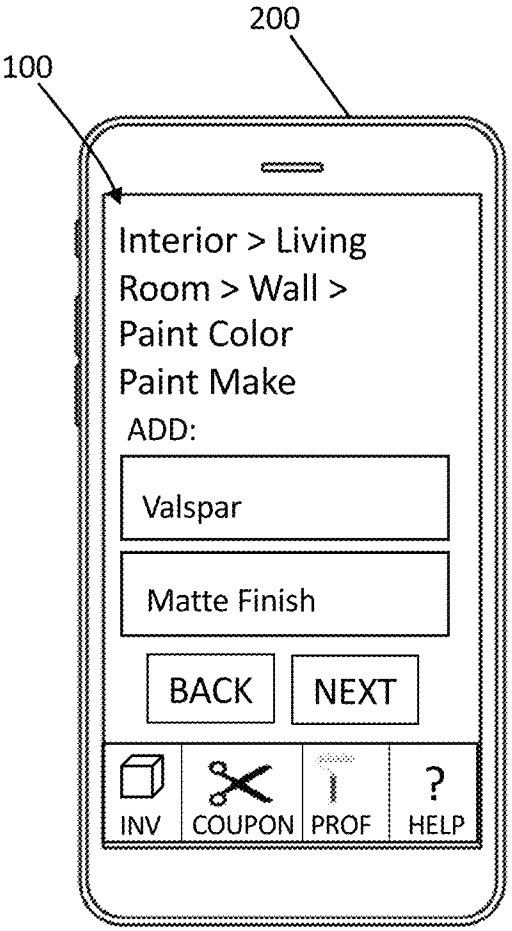
Figure 13H:
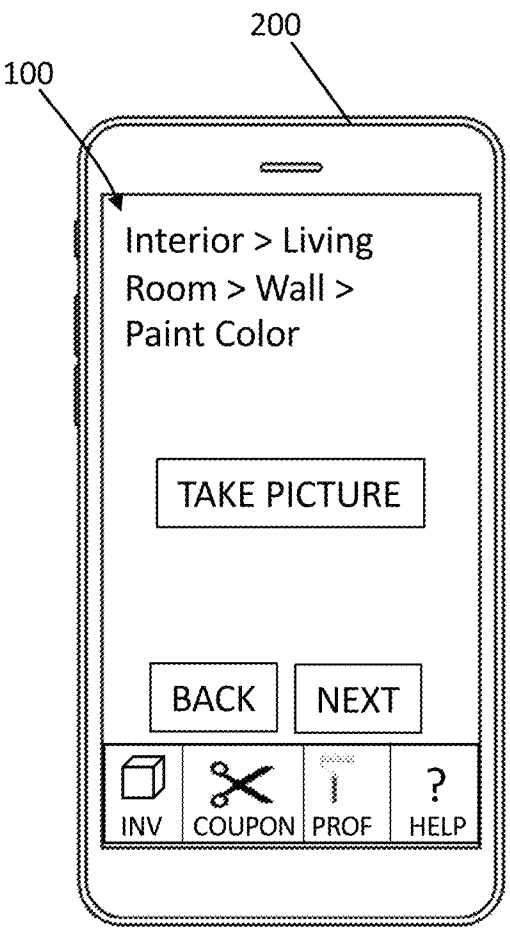
Figure 13I:
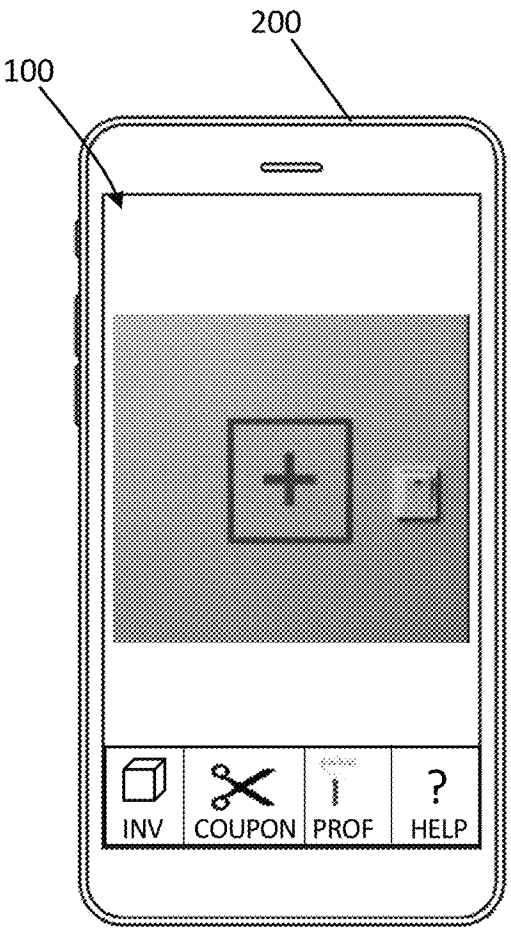
Figure 13J:
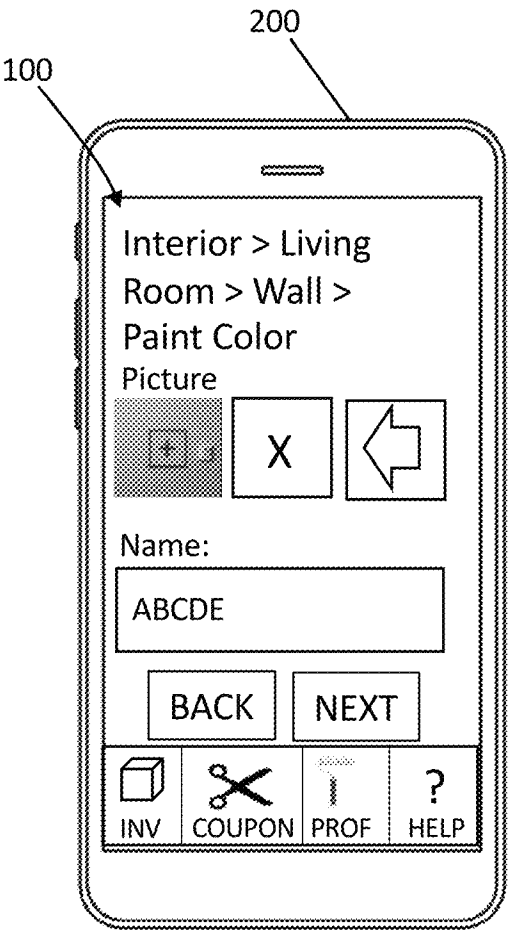
Figure 13K:
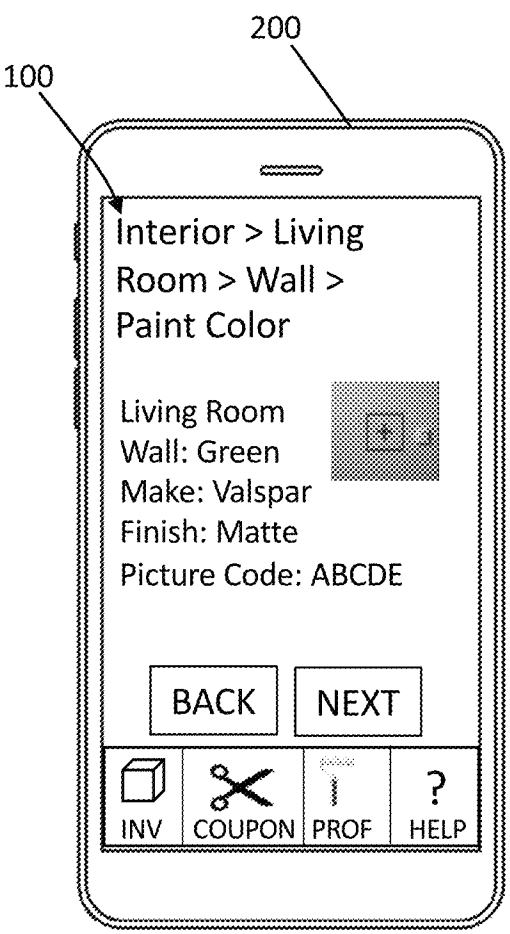
Figure 13L:
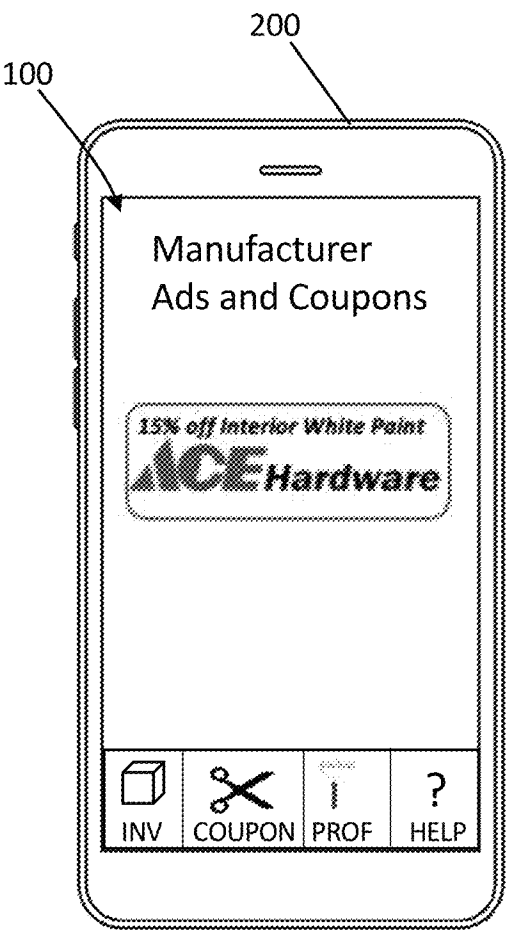
Figure 13O:
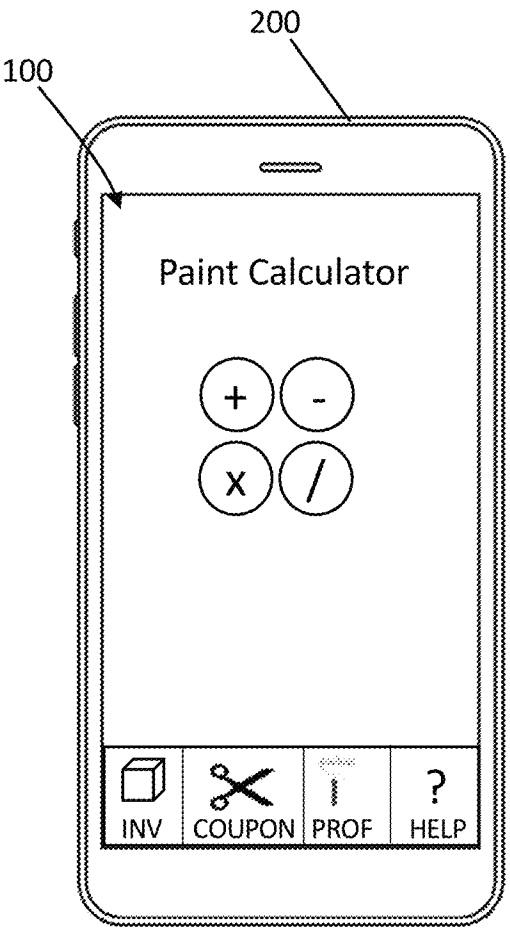

With reference to FIGS. 13A through 13O, at least one embodiment of the present invention also includes an application, such as, but not limited to a mobile application, which can be used in connection with the can stacking and organization device 10 described herein or independent of (e.g., without the use of) the can stacking and organization device 10. In particular, the application, generally referenced as 100, of at least one embodiment may be accessed by or from a user device 200, that may include, among other components and devices structured to facilitate implementation of the present invention in the intended manner, a processor, memory, a data storage device, and one or more communication modules.

Specifically, as used herein, the processor of at least one embodiment may include any device cooperatively structured to execute or implement computer instructions, software, etc., including, for example, the various features and components as described in accordance with at least one embodiment of the present invention, such as the application 100 described herein. The memory device, as used herein, may include but is not limited to random access memory (RAM) or other like devices configured to implement the present invention in the intended manner, for example, by storing and assisting with the execution of one or more applications, modules, or components capable of implementing the application 100 and features thereof as described herein. In some cases, the processor and memory can be combined to a single microcontroller as is known in the art. Further, the data storage device, as used herein, may include a hard disk drive, solid state drive, virtual drive, cloud-based storage drive, or other types of volatile or non-volatile memory. It should be noted that non-transitory computer readable media includes all computer-readable media except for a transitory, propagating signal.

The one or more communication modules as used herein includes one or more modules implemented in hardware and/or software adapted to communicate a signal, message, phone call or data communication via one or more network (s), for example, to/from the user device 200. In particular, the network or communication channel as used herein may be defined as one or more telecommunication networks, including for example, wireless mobile telecommunications technology (e.g., third generation or 3G networks, fourth generation or 4G networks, fifth generation or 5G networks, long-term evolution or LTE networks, etc.) Other networks can include computer networks, the Internet, World Wide Web, global telex networks, data or TCP/IP networks, such as Wide Area Networks (WAN), Metropolitan Area Networks (MAN), Local Area Networks (LAN), Internet Area Networks (IAN), etc.

Accordingly, the user device 200 of certain embodiments or implementations of the present invention may include any mobile device or mobile terminal such as, but not limited to a mobile phone, smartphone, tablet computer, etc. (e.g., APPLE® iPHONE®, ANDROID® based phone, etc.), and/or any laptop or mobile computers, desktop computers, video (or other) game consoles, personal digital assistants, etc. Thus, in at least one embodiment, the application 200, as described herein, can be downloaded and/or installed on the user device for access thereto. In other cases, access to the application can be accomplished by visiting a designated web page or web site utilizing an web browser or other like application whether native to or subsequently downloaded on the device 200.

In any case, the application 200 of at least one embodiment can use the processing, storage and/or communication capabilities of the user device 200 to store and retrieve various information and data pertaining to the qualities of the cans, containers, or the paint (or other material) stored or disposed within the cans or containers. In some embodiments, other features may include, but are not limited to, assigning a specific and/or unique identifier for each of the cans or containers (which can be added to the label section 90), a listing or retrieval of local or nearby stores that sell or offer to sell the particular paint, item or material identified, an offer of one or more coupons, discounts or incentives from participating stores, offers from local or other service providers (such as, for example, painting services), tips (e.g., painting tips) from experts (e.g., storage temperatures, storage humidity levels, number of coats, etc.), the ability to find paint based on stored location within a building, etc.

With reference now to FIGS. 13A through 13O, an exemplary application 100 of the present invention is illustrated. For example, in FIG. 13A, a user may first need to register or otherwise create an account by entering certain identifying or unique information, such as, a name, user name, password, address, zip code, etc. The user account, and corresponding information, may be stored locally on the device 200 itself, or more likely, remotely at a server or other management system (not shown).

With the user account created, the user may begin to store, track and manage various information about the contents of the cans or other containers. While paint and paint cans are used in the illustrated example, as provided herein, it should be noted that other materials in addition to or instead of paint may be used and are within the full spirit and scope of the present invention.

As shown in FIG. 13B, the user may be presented with an option to select "exterior" or "interior" or otherwise to select a particular or general location of where the paint or other material is to be applied or was applied. In this example, the user may indicate exterior paint to represent paint applied to the exterior of the house or building, or interior paint, to represent paint applied to the interior of the building.

For purposes of this illustration, FIG. 13C shows the selection of "interior" and then presents the user with a list of more specific locations of the interior of the home or building. Each item can be selected to further narrow down the location of which the paint is or will be applied. In this example, and as shown in FIG. 13D, the "living room" was selected, whereupon the user is provided with even further locations to further narrow down or specify where the paint is or will be applied.

Once the specific location of where the paint is or will be applied is determined (e.g., based on the user's selections of the successive options provided by the application 100), the user can now identify or specify details pertaining to the product, which again, in this example, is paint. More specifically, in FIGS. 13E, 13F and 13G, the user is able to identify the color (e.g., "Green"), the make (e.g., "Valspar"), and the particular finish (e.g., "Matte Finish"). Depending on the material, other options or specifications of the product or material may be provided or specified.

Furthermore, in FIGS. 13H, 13I and 13J, the user may also capture an image, photograph, or in some cases, a video of the location and/or the paint. In addition, the user may take one or more images, photographs, or videos of the paint can or container that was used to paint the particular location (in this example, the "living room" "wall"). With one or more pictures of the location (e.g., living room wall) and/or the paint can or container, itself, as well as the particular details of the paint (e.g., the color, make, and finish), as shown in FIG. 13K, subsequent recollection of the paint used is simple and easy. For instance, in the event the user would like to duplicate the paint (e.g., for touching up the paint or for matching the paint for any reason) the information pertaining to the particular paint used is stored via the application 100 (e.g., locally on the device 200 or remotely on a server or in the cloud) and can be easily recalled via the application 100.

In some cases, the user may store one or more photographs of the bar code, UPC code, QR code, or other encoded information located on the paint (or other) can. In such a case, the code can be subsequently scanned via the photograph(s), either via the application 100 or via a third party scanner, to easily identify the specifics pertaining to the paint or other material. In some cases, the application 100 may include a scanner, bar code reader or other machine code reader, which can allow the user to simply scan the code on the paint (or other) can to input the specifics of the paint that may be stored in the code (e.g., make, color, finish, tint, etc.).

In yet another implementation, artificial intelligence or other image recognition technology (e.g., as implemented by or similar to GOOGLE LENS®) may be used to easily identify the product of which the user took a picture or even pointed the camera on the user device 200 at. For example, the application 100 may be implemented to automatically identify certain specifics of the material by taking a photo or pointing the camera at the product. Some of the specifics or information that may be automatically identified may include the type or product (e.g., paint), the make (e.g., Valspar), the color (e.g., green) and the finish (e.g., matte finish).

Additional features of the application 100 are illustrated in FIGS. 13L, 13M, 13N, and 13O. For example, with reference to FIG. 13L, in some embodiments, the application 100 may generate or communicate coupons or other incentives to the user. In some cases, the application 100 may identify the material which the user added to the application 100, e.g., paint or a particular color or brand of paint, and may generate one or more coupons or incentives based thereupon. In other embodiments, the location of the user or other demographic information may be used in determining what coupons or incentives to provide.

Figure 13N:
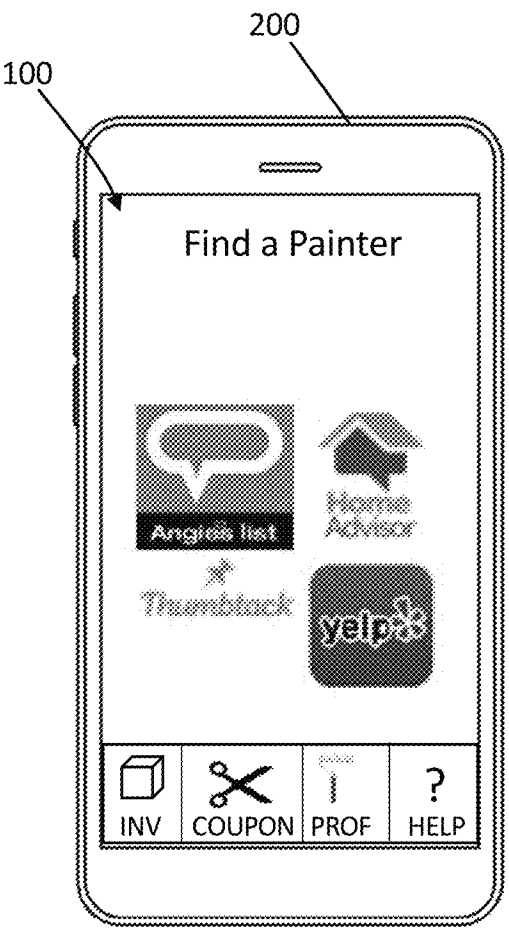
Figure 13M:
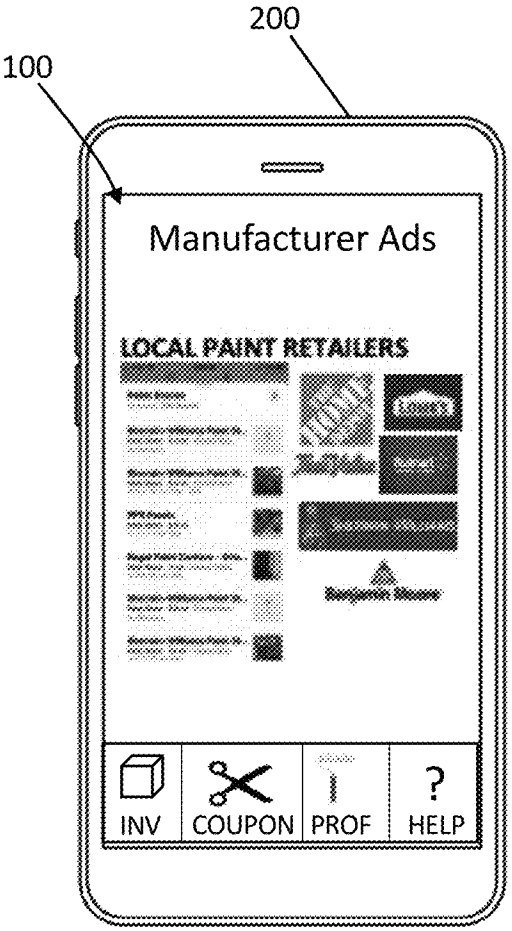

With reference to FIG. 13M, local retailers of the material (e.g., local paint retailers) may be identified to the user. In some cases, the local retailers may purchase advertisements or advertisement space which can then be provided to the user(s).

Similarly, FIG. 13N illustrates a feature where a user can use the application 100 in order to find professional to assist with a project, such as a painting project. In this case, the user may be able to search for local painters or local contractors that may be able to assist or provide painting (or other) services.

Yet another feature of at least one embodiment may include a paint calculator, as shown in FIG. 13O. This feature can be used by the user of the application 100 to calculate how much paint may be needed for a particular project, wall or space.

Furthermore, in some embodiments, the application 100 may be used to track or manage the level of paint or other material remaining in the corresponding can, bucket or container. As an example, the application 100 may be used to maintain the level or amount of paint in the can, such as, by entering ¼, ½, ¾ etc. In some implementations, the level may be manually entered by a user of the applications, while in other embodiments, an algorithm or artificial intelligence may be used to estimate the level of paint remaining, for example, based on the amount of time since last purchase, the amount of paint applied or used, etc. In either case, the level of paint or other material remaining in the can or other container can be used for purposes of inventory control or management and/or for purposes of determining when or if more paint needs to be reordered or purchased.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A can stacking device, comprising:

at least one body segment, said at least one body segment comprising an outer wall, an intermediate wall and an inner wall, a first trough defined between said outer wall and said intermediate wall, said first trough comprising a continuous annular configuration, said first trough comprises a bottom surface, wherein said outer wall comprises an inner height extending from said bottom surface of said first trough that is greater than an outer height of said intermediate wall extending from said bottom surface of said first trough, a second trough defined between said intermediate wall and said inner wall, said second trough comprising a continuous annular configuration, said second trough comprises a bottom surface, wherein said intermediate wall comprises an inner height extending from said bottom surface of said second trough that is greater than a height of said inner wall extending from said bottom surface of said second trough, said intermediate wall comprises a top surface, wherein a plurality of indentations are formed upon said top surface of said intermediate wall between said first trough and said second trough fluidically interconnecting said first trough to said second trough, wherein a fluid will overflow from said first trough to said second trough through said plurality of indentations, wherein a top surface of said outer wall, said top surface of said intermediate wall and a top surface of said inner wall comprise concentric circular configurations, and wherein said inner wall comprises an inwardly sloped configuration.

2. The can stacking device as recited in claim 1 wherein each of said plurality of indentations are equidistantly spaced upon said top surface of said intermediate wall.

3. The can stacking device as recited in claim 1 wherein said outer wall and said intermediate wall comprise concentric circular configurations.

4. The can stacking device as recited in claim 1 wherein said inner wall defines an inner aperture.

5. The can stacking device as recited in claim 1 wherein at least one body segment comprises a plurality of body segments joined to one another along common edges.

6. The can stacking device as recited in claim 5 wherein said plurality of body segments define a bottom portion comprising a plurality of cooperative recesses to facilitate stacking of a plurality of can stacking devices.

7. The can stacking device as recited in claim 6 wherein said continuous outer wall, said intermediate wall and said inner wall fit within corresponding ones of said plurality of cooperative recesses of a stacked can stacking device.

8. A can stacking device, comprising:

a plurality of body segments joined to one another at common edges, each of said plurality of body segments comprising:

a circular outer wall, a circular intermediate wall, a circular inner wall, a first annular trough defined between said circular outer wall and said circular intermediate wall, a second annular trough defined between said circular intermediate wall and said circular inner wall, and a plurality of indentations formed upon a top surface of said intermediate wall extending between said first trough and said second trough, said at least one indentation fluidically interconnecting said first trough to said second trough, wherein a fluid will overflow from said first trough to said second trough through said at least one indentation, wherein said circular outer wall and said circular intermediate wall comprise concentric circular configurations, and wherein said circular inner wall comprises an inwardly sloped configuration.

9. The can stacking device as recited in claim 8 wherein said circular inner wall defines an inner aperture.

10. The can stacking device as recited in claim 9 wherein said first trough comprises a bottom surface, and wherein said circular outer wall comprises an inner height extending from said bottom surface of said first trough that is greater than an outer height of said circular intermediate wall extending from said bottom surface of said first trough to said top surface of said intermediate wall.

11. The can stacking device as recited in claim 10 wherein said second trough comprises a bottom surface, and wherein said circular intermediate wall comprises an inner height extending from said bottom surface of said second trough that is greater than a height of said circular inner wall extending from said bottom surface of said second trough.

12. A can stacking device, comprising:

a plurality of body segments joined to one another along common edges, each of said plurality of body segments comprising an outer wall, an intermediate wall and an inner wall, a first trough defined between said outer wall and said intermediate wall, said first trough comprising a continuous annular configuration, said first trough comprises a bottom surface, wherein said outer wall comprises an inner height extending from said bottom surface of said first trough that is greater than an outer height of said intermediate wall extending from said bottom surface of said first trough, a second trough defined between said intermediate wall and said inner wall, said second trough comprising a continuous annular configuration, said second trough comprises a bottom surface, wherein said intermediate wall comprises an inner height extending from said bottom surface of said second trough that is greater than a height of said inner wall extending from said bottom surface of said second trough, wherein said plurality of body segments define a bottom portion comprising a plurality of cooperative recesses to facilitate stacking of a plurality of can stacking devices, wherein said continuous outer wall, said intermediate wall and said inner wall fit within corresponding ones of said plurality of cooperative recesses of a stacked can stacking device.

* * * * *